United States Patent [19]

Josephson

[11] 4,404,780

[45] Sep. 20, 1983

[54] SUPPORT SYSTEM FOR RESTRAINING LATERAL MOVEMENT OF PIER-MOUNTED BUILDING

[76] Inventor: Martin Josephson, 718-27 Sycamore Ave., Vista, Calif. 92083

[21] Appl. No.: 244,208

[22] Filed: Mar. 16, 1981

[51] Int. Cl.[3] ..... E04D 15/00; E04G 21/00

[52] U.S. Cl. ..... 52/126.7; 52/23; 52/126.5; 52/126.6; 52/143; 52/292; 52/299; 52/DIG. 11; 248/357; 254/98

[58] Field of Search ..... 52/299, DIG. 11, 143, 52/292, 23, 126.5, 126.6, 126.7; 254/89 R, 92, 98, 133; 248/352, 354 S, 357; 280/475

[56] References Cited

U.S. PATENT DOCUMENTS

| | | | |
|---|---|---|---|
| 319,558 | 6/1885 | Carpenter | 52/292 |
| 2,140,617 | 12/1938 | Castady | 52/98 |
| 2,956,653 | 10/1960 | Liskey, Jr. | 52/403 |
| 3,074,693 | 1/1963 | Shumake | 254/98 |
| 3,606,231 | 9/1971 | Kilborn | 52/292 |
| 3,828,491 | 8/1974 | Koon et al. | 52/DIG. 11 |

FOREIGN PATENT DOCUMENTS

| | | | |
|---|---|---|---|
| 2283272 | 3/1976 | France | 52/126.5 |
| 543853 | 3/1942 | United Kingdom | 248/354 S |

*Primary Examiner*—John E. Murtagh
*Assistant Examiner*—Mark J. Sofia
*Attorney, Agent, or Firm*—Brown & Martin

[57] ABSTRACT

A system for restraining a building having I-beams secured to the bottom of the building from moving laterally from supporting positioned beneath the I-beams. The system includes a plurality of tongues secured to and extending vertically from the tops of a corresponding plurality of the piers; and a corresponding plurality of socket members defining horizontally enclosed vertical sockets secured to the I-beams for receiving the vertically extending tongues for restraining lateral movement of the building from the piers.

8 Claims, 5 Drawing Figures

SUPPORT SYSTEM FOR RESTRAINING LATERAL MOVEMENT OF PIER-MOUNTED BUILDING

BACKGROUND OF THE DISCLOSURE

The present invention generally pertains to systems for supporting buildings off the ground and is particularly directed to preventing lateral movement of buildings that are supported on piers.

Buildings such as mobile homes are supported off of the ground by piers positioned beneath the building. The typical mobile home building has supporting I-beams secured to the bottom of the building and these I-beams rest on piers to support the building above the ground.

During earthquakes, vibrations that are transmitted through the ground sometimes cause buildings that are so supported to be shifted laterally, whereby the supporting I-beams slide off of the piers and the building falls. Oftentimes this results in severe structural damage to the building.

SUMMARY OF THE INVENTION

The present invention is a system for restraining a building having I-beams secured to the bottom of the building from moving laterally from supporting piers positioned beneath the I-beams. The system of the present invention includes a plurality of tongues secured to and extending vertically from the tops of a corresponding plurality of the piers; and a corresponding plurality of socket members defining horizontally enclosed vertical sockets secured to the I-beam for receiving the vertically extending tongues for restraining lateral movement of the building from the piers.

Additional features of the present invention are described in relation to the description of the preferred embodiments.

DESCRIPTION OF THE PREFERRED EMBODIMENT

Figure 5:
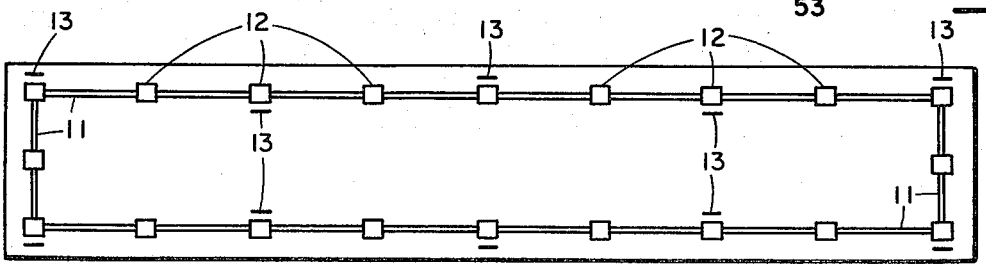
FIG. 5 is a schematic view of the underside of a building having I-beams secured to the bottom of the building and supported on piers, wherein the view shows the placement of the system of the present invention in relation to the overall breadth of the building.

A building 10 having I-beams 11 secured to the bottom of the building is supported by piers 12 positioned beneath the I-beams 11. The building is restrained from moving laterally from the piers 12 by the system of the present invention. Although only one pier 12 is shown in FIG. 1, the placement of the I-beams 11 upon a plourality of piers 12 is illustrated in FIG. 5, which schematically depicts the bottomside of the building 10.

Figure 1:
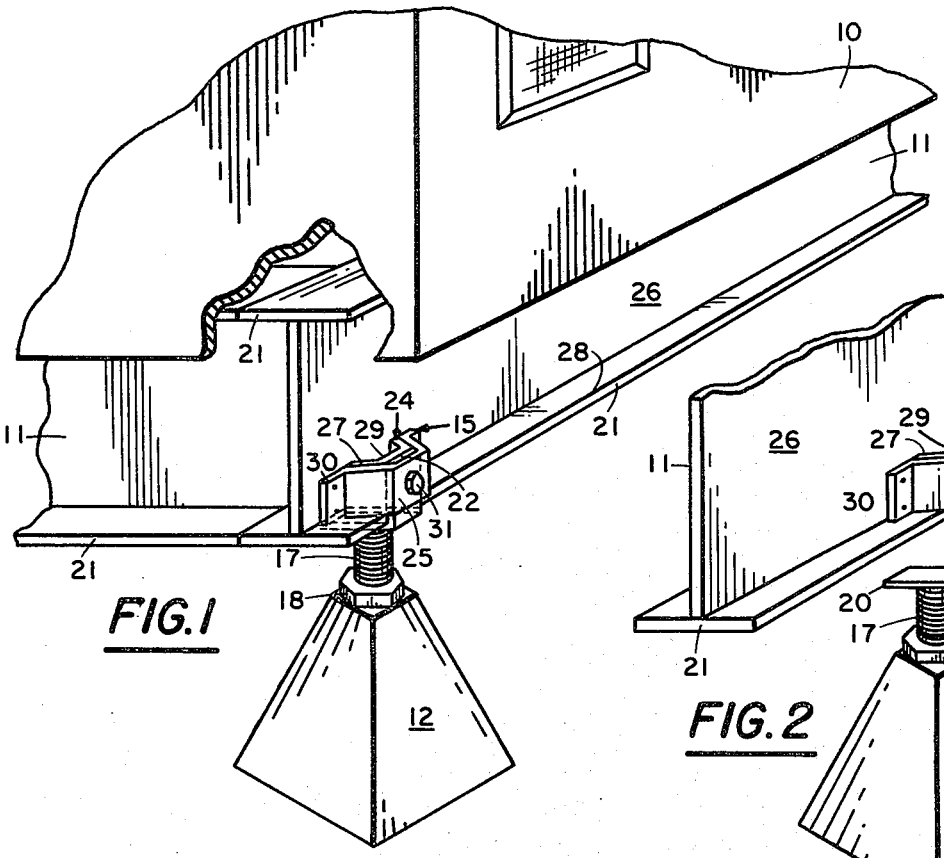
FIG. 1 is a perspective view with a portion of the structure broken away showing a corner of a building supported by an I-beam on a pier and restrained from lateral movement by one preferred embodiment of the system of the present invention.

For simplicity, the system of the present invention is illustrated in detail at only one pier 12 in FIG. 1. It is to be understood that the system of the present invention is installed at a plurality of the supporting piers 12 as indicated by the lines 12 shown in FIG. 5, but not necessarily at all of the piers 12. Preferably, the supporting system 13 is positioned at every other pier 12 and is alternated from one side of the I-beams 11 to the other at such positions.

As seen more clearly in FIG. 1, each vertically extending tongue 14 is provided by an angle bracket 16 that is attached to the top of a vertical jack screw 17. The vertical jack screw 17 is engaged by an adjusting nut 18 on the top of the pier 12. The angle bracket 16 further includes a horizontal base 20 that extends beneath the bottom flange 21 of the I-beam 11 to thereby seat the I-beam 11 on the top of the pier 12. The I-beams 11 are disposed with the flanges 21 thereof extending horizontally. The tongue 14 is inserted into a vertical socket 22 in the corresponding socket member 15 and the bottom flange 21 of the I-beams 11 is seated on the horizontal base 20. The jack screw 17 and the adjusting nut 18 are adjusted to support the building 10 at a desired height above the ground as shown in FIG. 1.

Figure 2:
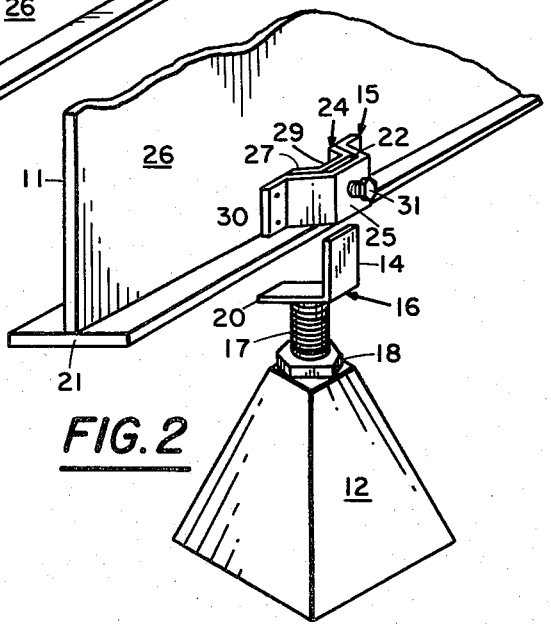
FIG. 2 is an exploded perspective view better showing the components of the preferred embodiment of the FIG. 1.
Figure 3:
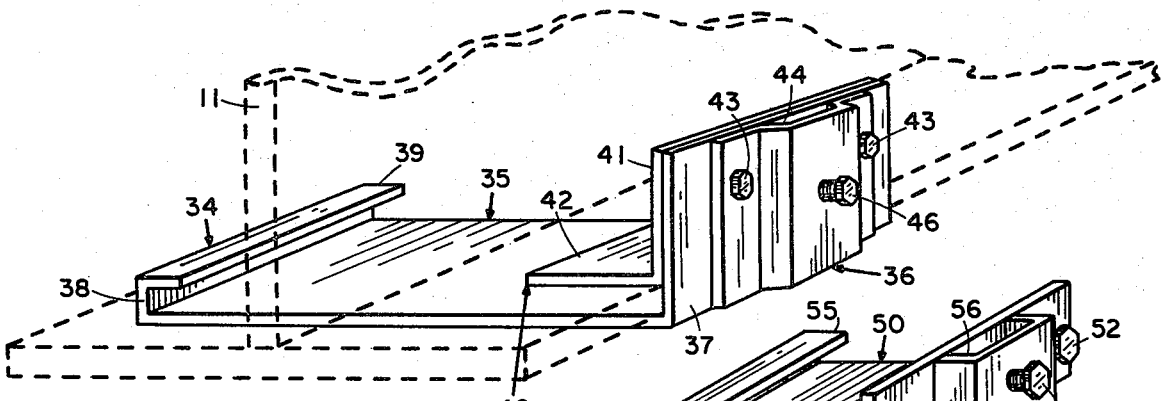
FIG. 3 is a perspective view of a socket member for an alternative embodiment of the system of the present invention, wherein an I-beam is shown in dashed lines to illustrate how the socket member is secured thereto.
Figure 4:
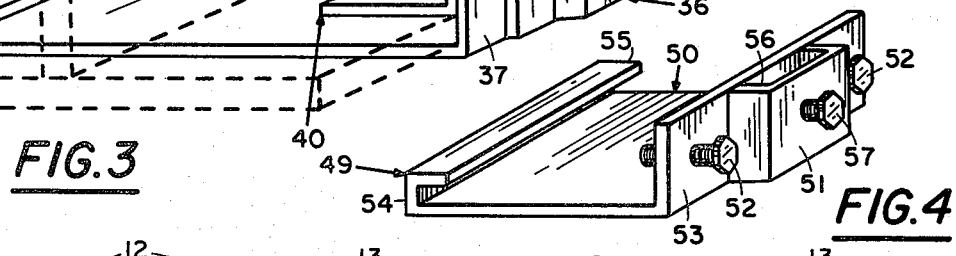
FIG. 4 is a perspective view of a socket member for another preferred embodiment of the system of the present invention.

Alternative preferred embodiments of the socket member are shown in FIGS. 2, 3 and 4.

Referring to FIG. 2, the socket member 15 includes a spacing member 24 and a U-bracket 25. The spacing member 24 faces the web 26 of the I-beam 11 and includes side walls 27 that extend to at least the edge 28 of the bottom flange 21 of the I-beam 11. The spacing member 24 further includes a vertical end wall 29. The U-bracket 25 is deposed in relation to the spacing member 24 for defining the vertical socket 22 between the U-bracket 25 and the vertical end wall 29 of the spacing member 24 for receiving the tongue 14. The U-bracket 25 has attachment flanges 30 secured to the web 26 of the I-beam 11. A set screw 31 is threaded through the U-bracket 25 for securing the tongue 14 within the vertical socket 22.

Referring to FIG. 3, an alternative embodiment of a socket member 34 includes fitted bracket 35 and a U-bracket 36. The fitted bracket 35 includes a vertical sidewall 37; an end wall 38 extending horizontally beyond the width of the bottom flange 21 of the I-beam 11; a hook flange 39 fitted over the top of one side of the bottom flange 21 of the I-beam 11; and an angle bracket 40 attached to the vertical side 37 wall so as to fit over the top of the other side of the bottom flange 21 of the I-beam 11. The angle bracket 40 has a first tongue 41 that is broadly attached to the side of the vertical side wall 37 of the fitted bracket 35 that faces the web 26 of the I-beam 11, and a second tongue 42 that extends horizontally so as to fit over the top of the other side of the bottom flange 21 of the I-beam 11.

The U-bracket 36 is secured to the vertical side wall 37 of the fitted bracket 35 for defining a vertical socket 44 between the bracket 36 and the vertical side wall 37 of the fitted bracket 35 for receiving a tongue 14. The U-bracket 36 has attachment flanges and is secured to the vertical side wall 37 by bolts through such attachment flanges.

The fitted brackets 35 is fitted over the thereby attached to the bottom flange 21 of the corresponding I-beam 11. When the tongue 14 is inserted into the vertical socket 44, the horizontal base 20 secured to the top of the pier 12 extends beneath the bracket 35 that is fitted over the bottom flange 21 of the I-beam 11 to thereby seat the fitted bracket 35 on the top of the pier 12.

A set screw 46 is threaded through the U-bracket 36 for securing the tongue 14 within the vertical socket 44.

Referring to FIG. 4 another alternative embodiment of a socket member 49 includes a fitted bracket 50 a U-shaped member 51 and two threaded bolts 52. The fitted bracket 50 includes a vertical side wall 53, an end wall 54 and a hook flange 55. The fitted bracket 50 is dimensioned to fit over the bottom flange 21 of the I-beam 11 in the same manner as the fitted bracket 35 in the socket member 34 shown in FIG. 3. However, in lieu of the angle bracket 40 that is included in the fitted bracket 35 (FIG. 3), the two bolts 52 are threaded through the vertical side wall 53 of the fitten bracket 40 (FIG. 4) and extend horizontally so as to fit over the top of one side of the bottom flange of an I-beam 11.

The U-shaped member 51 is secured to the vertical side wall 53 of the bracket 50 for defining a vertical socket 56 between the U-shaped member 51 and the vertical side wall 53 of the bracket 50 for receiving a tongue 14. A set screw 57 is threaded through the U-shaped member 51 for securing the tongue 14 within the vertical socket 56.

I claim:

1. In a system wherein a building having I-beams secured to the bottom of the building is supported by piers positioned beneath the I-beams, a system for restraining the building from moving laterally from the piers, comprising a plurality of tongues secured to and extending vertically from the tops of a corresponding plurality of the piers; and a corresponding plurality of socket members defining horizontally enclosed vertical sockets secured to the I-beams for receiving the vertically extending tongues for restraining lateral movement of the building from the piers.

2. A system according to claim 1, comprising a plurality of angle brackets respectively secured to the tops of the piers, wherein individual angle brackets comprise the tongue that extends vertically from the pier; and a horizontal base secured to the top of the pier and extending beneath of a bottom flange of a corresponding I-beam to thereby seat the I-beam on the top of the pier.

3. A system according to claim 1, wherein the I-beams are disposed with the flanges thereof extending horizontally, and wherein individual socket members comprise spacing means facing the web of the corresponding I-beam and including side walls extending to at least the edge of a bottom flange of the I-beam, and a vertical end wall; and U-shaped means disposed in relation to the spacing means for defining a vertical socket between the U-shaped means and the end wall of the spacing means for receiving the corresponding tongue.

4. A system according to claim 3, wheren the U-shaped means comprises a U-bracket having attachment flanges secured to the web of the I-beam.

5. A system according to claim 1, wherein the I-beams are disposed with flanges thereof extending horizontally, and wherein individual socket members comprise a bracket fitted over and thereby attached to a bottom flange of a corresponnding I-beam, and including a vertical side wall; and U-shaped means secured to the vertical side wall of the bracket for defining a vertical side wall of the bracket for receiving the corresponding tongue.

6. A system according to claim 5, wherein the bracket comprises an end wall extending horizontally beyond the width of the bottom flange of the I-beam;

a hook flange fitted over a top of one side of the bottom flange of the I-beam; and means attached to the vertical side wall fitted over the top of the other side of the bottom flange of the I-beam.

7. A system according to claim 6, wherein the last-recited means comprises an angle bracket having a first tongue broadly attached to the side of the vertical side wall of the bracket that faces the web of the I-beam, and a second tongue extending horizontally and fitted over the top of the other side of the bottom flange of the I-beam.

8. A system according to claim 5, comprising a plurality of angle brackets respectively secured to the tops of the piers, wherein individual angle brackets comprise the tongue that extends vertically from the pier; and a horizontal base secured to the top of the pier and extending beneath the bracket that is fitted over the bottom flange of the I-beam to thereby seat the fitted bracket on the top of the pier.

* * * * *